US005942130A

United States Patent [19]

Leung

[11] Patent Number: 5,942,130

[45] Date of Patent: Aug. 24, 1999

[54] SOLID BOWL CENTRIFUGE WITH BEACH HAVING DEDICATED LIQUID DRAINAGE

[75] Inventor: Woon-Fong Leung, Sherborn, Mass.

[73] Assignee: Baker Hughes Incorporated, Houston, Tex.

[21] Appl. No.: 08/950,848

[22] Filed: Oct. 15, 1997

Related U.S. Application Data

[60] Provisional application No. 60/028,285, Oct. 18, 1996.

[51] Int. Cl.[6] ..... B04B 1/00

[52] U.S. Cl. ..... 210/781; 210/787; 210/791; 210/360.1; 210/374; 210/380.1; 210/380.3; 210/391; 210/409; 494/36; 494/37

[58] Field of Search ..... 210/360, 374, 210/380.1, 380.3, 500.1, 391, 409, 498, 499, 781, 787, 791; 494/27, 50, 51, 52, 53, 54, 55, 56, 57, 58, 59, 36, 37

[56] References Cited

U.S. PATENT DOCUMENTS

| | | | |
|---|---|---|---|
| 4,190,194 | 2/1980 | Amero | 494/53 |
| 5,067,939 | 11/1991 | Shapiro . | |
| 5,653,674 | 8/1997 | Leung . | |

FOREIGN PATENT DOCUMENTS

| | | |
|---|---|---|
| 0 787 532 A1 | 8/1997 | European Pat. Off. . |
| 963409 | 5/1957 | Germany . |
| 40 33 069 | 4/1992 | Germany . |
| 62-019266 | 1/1987 | Japan . |
| 1 125 244 | 8/1968 | United Kingdom . |
| 2 016 963 | 9/1979 | United Kingdom . |

OTHER PUBLICATIONS

*Research Disclosure*; Mar. 1993, No. 347, pp. 191–192.

*Primary Examiner*—David A. Reifsnyder
*Attorney, Agent, or Firm*—R. Neil Sudol; Henry D. Coleman

[57] ABSTRACT

Liquid is drained from the cake in the beach section of a centrifuge bowl by providing a dedicated flow path or a series of flow paths from the beach section. The flow path or paths are designed to drain away expressed liquid while maintaining substantially the flow of cake up the beach to the cake discharge opening(s) irrespective of solid throughput. The expressed liquid is guided from the beach section back to the slurry pool in the cylindrical section of the centrifuge bowl. More specifically, one or more liquid guide channels may be provided in the beach area under the surface supporting the cake flow towards the cake discharge end of the centrifuge. The liquid guide channels may be established by providing a porous liner along the beach section of the centrifuge bowl. Preferably, the liner extends down the beach at least to the level of the pool.

30 Claims, 10 Drawing Sheets

SOLID BOWL CENTRIFUGE WITH BEACH HAVING DEDICATED LIQUID DRAINAGE

CROSS-REFERENCE TO A RELATED APPLICATION

This application relies for priority purposes on U.S. provisional application No. 60/028,285 filed Oct. 18, 1996.

BACKGROUND OF THE INVENTION

This invention relates to a solid bowl centrifuge. More particularly, this invention relates to a solid bowl centrifuge with a beach area between a pool section and a cake discharge opening.

Some slurries containing granular solids, such as plastics or polymers, are mechanically dewatered by a solid bowl centrifuge to the lowest possible moisture before being sent for thermal drying. In the solid bowl centrifuge, as illustrated in FIG. 1A, the solids in the feed slurry rapidly settle out to a cylindrical wall 10 of the centrifuge bowl 12, forming a granular cake 14*c*. The cake, by a differential rotation between a screw-type conveyor 16 and the bowl 12, is transported from a cylinder section of the bowl to a conical section 18 thereof. Also, an annular slurry pool 20 forms in the bowl. The cake 14 is moved through from below the pool to above the pool in the conical section 18 which is commonly referred to as the dry beach. There, inasmuch as the cake is outside the pool of liquid, the cake can further dewater, with liquid draining through the cake as a result of the centrifugal gravity G. The drained water passes through a gap 22 formed between the conveyor blade tip 24 and the inner surface 26 of the conical bowl wall or section 18. A pressure face 28 of the conveyor blade 30 (see FIG. 1A) and the inner surface 26 of the conical section 18 of the bowl 12, together with the blade tip gap 22, form a funnel through which the liquid filtrate passes under the influence of centrifugal gravity G. After the liquid flows through this gap 22, the water runs down along a helical space adjacent to a trailing face 32 of conveyor blade 30.

This drainage scenario is possible at low solids throughput provided that the cake profile does not bridge across the channel 34 (FIG. 1A) formed between adjacent screw conveyor flights or blades 30. The cake surface has an angle of repose a which is typically 15°–45° with respect to the axis 18*a* of the machine. The cake profile formed depends on the solids throughput, the beach angle β and the angle of repose a which in turn is a function of the physical properties of the cake as well as the moisture content. The larger the angle of repose α, the less likely the cake will bridge across adjacent flights or wraps of the conveyor blade 30.

At high solids throughput, the cake thickness 14*a* and width 14*b* both increase, as illustrated in FIG. 1B. The cake width eventually increases above the pitch (distance between adjacent flight discounting the blade thickness) to span across the entire helical channel 34. The helical space which would allow the liquid to run down the conical beach section 18 to the pool 20 is blocked or filled up by the cake. In this case, the "expressed" liquid 22*a* from the cake has to permeate through the relatively impervious cake back to the pool 20 along the conical beach section 18 by a component of centrifugal force acting along the beach. In between successive wraps of the helical channel 34, the liquid has to run through the gap 22 between the blade tip and the bowl. The controlling factors on draining the liquid down the beach 18 are the G-force, beach angle, and cake permeability which depends on the particle average size and distribution. The drainage rate is therefore much reduced as compared to the case at low solids throughput where the helix space behind the trailing face of the blade is not blocked by the cake and available for drainage. Consequently, most of the expressed liquid, instead of draining back to the pool 20, is carried along with the cake towards the cake discharge 22*b,* rendering the cake very wet.

FIG. 2 is a graph illustrating the variation of cake moisture as a function of cake throughput based on dry solids mass rate. FIG. 2 graphically indicates the result of the above-described drainage process. At low solids throughput, to the left of a critical point CP, the cake moisture increases only slightly with increasing throughput due to increase in cake thickness which gives higher resistance to liquid drainage within the cake. This slight increase of moisture with throughput ceases to hold after a certain throughput, corresponding to critical point CP. A further increase in cake throughput rate beyond the critical point CP triggers a much higher increase in cake moisture, as indicated by the graph line to the right of the critical point CP in FIG. 2. Above this critical rate, the cake width is large enough to span the entire channel 34, blocking liquid drainage. Typically, for cake with fine granular polymeric solids, the liquid does not effectively drain down the slope through the cake bed despite the centrifugal gravity and the steep beach. Therefore, any expressed liquid from the cake is carried with the cake to the discharge opening, thus yielding wet cake. The cake can reach 100% liquid saturation (i.e., void volume within cake all filled with liquid) or high moisture content, resulting in a steep rise in moisture with increasing rate. Short of increasing the pitch and/or beach angle, both of which has other negative impacts on process performance and mechanical condition of the machine, the present disclosure provides two innovative designs in which the beach angle end the pitch need not be compromised.

BRIEF DESCRIPTION

In accordance with an embodiment of the invention, liquid is drained from the cake in the beach section of the centrifuge bowl by providing a dedicated flow path or a series of flow paths from the beach section. The flow path or paths are designed to drain away expressed liquid while maintaining substantially the flow of cake up the beach to the cake discharge opening(s).

More specifically, a centrifuge comprises, in accordance with the present invention, a centrifuge bowl and a conveyor. The bowl has a beach section located between a pool area at one end of the bowl and a cake discharge opening at an opposite end of the bowl. The conveyor moves cake from the pool area to the cake discharge opening along a cake path on an inner surface of the bowl. The conveyor has a conveyor blade spaced from the inner surface of the bowl by a gap. The centrifuge is provided with structure, associated with the bowl or the conveyor, defining a dedicated flow path for draining away liquid expressed from cake on the beach section while maintaining cake flow up the beach section to the cake discharge opening. The dedicated flow path is different from the gap between the conveyor blade and the inner surface of the bowl and is further separated from the cake path on the beach section.

In accordance with a particular embodiment of the invention, the expressed liquid is guided from the beach section back to the slurry pool in the cylindrical section of the centrifuge bowl. More specifically, one or more liquid guide channels may be provided in the beach area under the surface supporting the cake flow towards the cake discharge end of the centrifuge. The liquid guide channels may be established by providing a porous liner along the beach section of the centrifuge bowl. Preferably, the liner extends down the beach at least to the level of the pool.

In another specific embodiment of the invention, the inner surface of the beach is formed by a mat of wedge-shaped or cross-sectionally trapezoidal wires. The wires may be alternatively oriented axially or circumferentially. The wires and associated spacer elements may be connected to one another to form a cage or basket insert. In any case, the porous liner, the wire mat, or the cage or basket insert is connected to the bowl and forms a part thereof.

In accordance with another particular embodiment of the invention, the expressed liquid is guided from the beach area of the centrifuge via perforations provided in a bowl liner in the beach area.

In another embodiment of the invention, the structure defining the dedicated flow path for expressed liquid includes a helical channel or recess formed in the conveyor blade for guiding liquid from the beach section to the pool area. The conveyor blade may be closed at an outer edge, with liquid entering the channel through a perforated filter surface provided on a downstream side of the conveyor blade. Alternatively, the channel or recess is formed in a blade tip having a generally A-shaped profile. In the latter case, the blade tip is provided on a leading side with a protective surface made of a wear resistant material.

Generally, it is contemplated that a centrifuge pursuant to the present invention also comprises a filter structure associated with the bowl or the conveyor. The filter structure defines, in the dedicated flow path, a filter inhibiting cake particles from entering the dedicated flow path while permitting flow of expressed liquid from the cake to the dedicated flow path. In accordance with another feature of the present invention, the centrifuge further comprises a feed path or liquid guide for feeding a cleaning liquid to the dedicated flow path for clearing the dedicated flow path of clogging cake particles. This feed path extends through the conveyor blade or, alternatively where a bowl head is provided at a cake discharge end of the bowl, extends through a channel or passage in the bowl head.

A method for operating a centrifuge utilizes, in accordance with the present invention, a centrifuge bowl having a beach section located between a pool area at one and of the bowl and a cake discharge opening at an opposite end of the bowl. The method comprises rotating the bowl about a rotation axis, moving cake from the pool area to the cake discharge opening along a cake path on the beach section during rotation of the bowl, capturing liquid expressed from the cake along the beach section also during rotation of the bowl, guiding the captured liquid away from the cake on the beach section via a dedicated flow path separated from the cake path, and, during capturing and guiding of the liquid, substantially maintaining a flow of cake along the beach section to the cake discharge opening.

According to further features of the present invention, the guiding of the captured liquid includes directing the captured liquid along approximately axially extending flow channel from the beach section back to the pool area.

According to additional features of the present invention, the capturing of the expressed liquid includes filtering the liquid to inhibit cake particles from entering the dedicated flow path, while cleaning liquid is fed or guided to the dedicated flow path for clearing the dedicated flow path of clogging cake particles.

DESCRIPTION OF THE PREFERRED EMBODIMENTS

Figure 3:
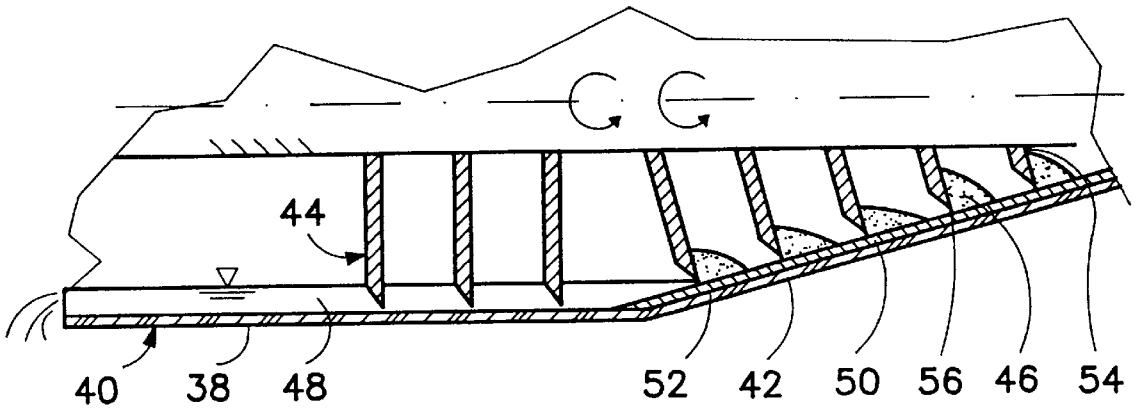
FIG. 3 is a schematic longitudinal cross-sectional view of a centrifuge with a beach liner in accordance with the present invention.

As illustrated in FIG. 3, a centrifuge bowl 40 has a cylindrical section 38 and a conical bowl section or beach 42. A screw-type conveyor 44 is provided for moving cake 46 from a pool 48 in the cylindrical bowl section 38 and up the beach to cake discharge openings (not shown). A liner 50 is provided on an inner surface 52 of the beach 42. As described in detail hereinafter with reference to FIGS. 5–9, liner 50 is provided with fluid flow channels which convey liquid expressed from cake 46 back into pool 48 under the influence of centrifugal gravity.

Conveyor 44 includes a blade 54 having a tip or free end 56 which should be spaced from liner 50 by typically less than 0.030 inch to reduce cake build-up in the gap between the blade and the liner. Cake build-up in that gap causes chatter (a stick-slip phenomenon) and reduction in filtration due to additional flow resistance.

Figure 4:
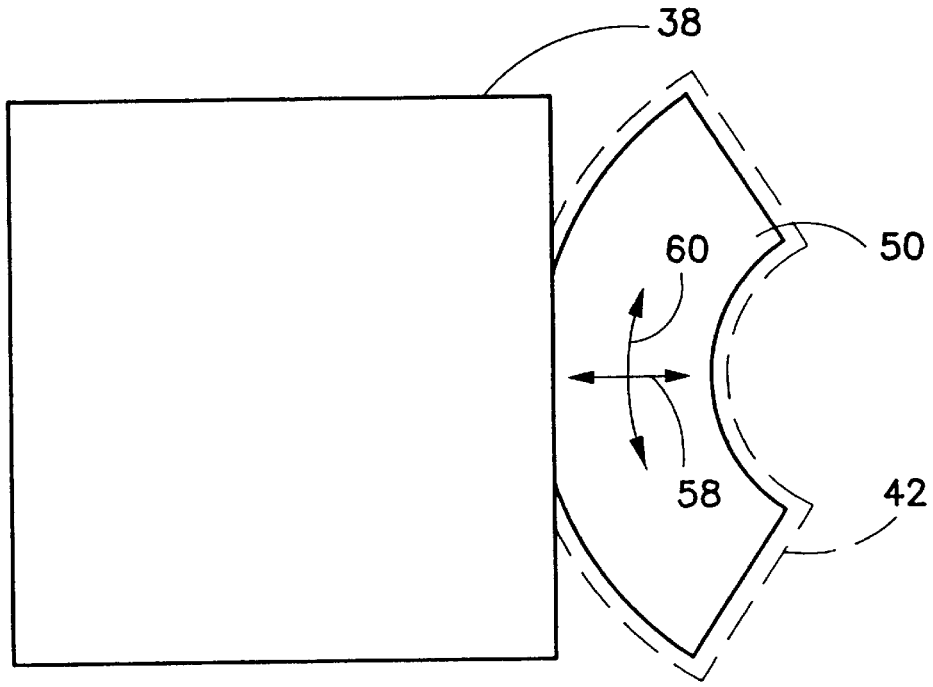
FIG. 4 is a schematic rolled out or developed view of a bowl shown in FIG. 3.

Liner 50 should extend to pool 48 to provide dedicated flow channels for liquid draining from the cake 46 in the conical or beach section 42. The dedicated channels in liner 50 guide the expressed liquid through the liner and axially down to the pool. Thus, the key is to provide a flow path which extends approximately axially, as opposed to circumferentially. Arrows 58 and 60 in FIG. 4 indicated axial and circumferential directions, respectively, in conical or beach section 42 of centrifuge bowl 40.

Figure 5:
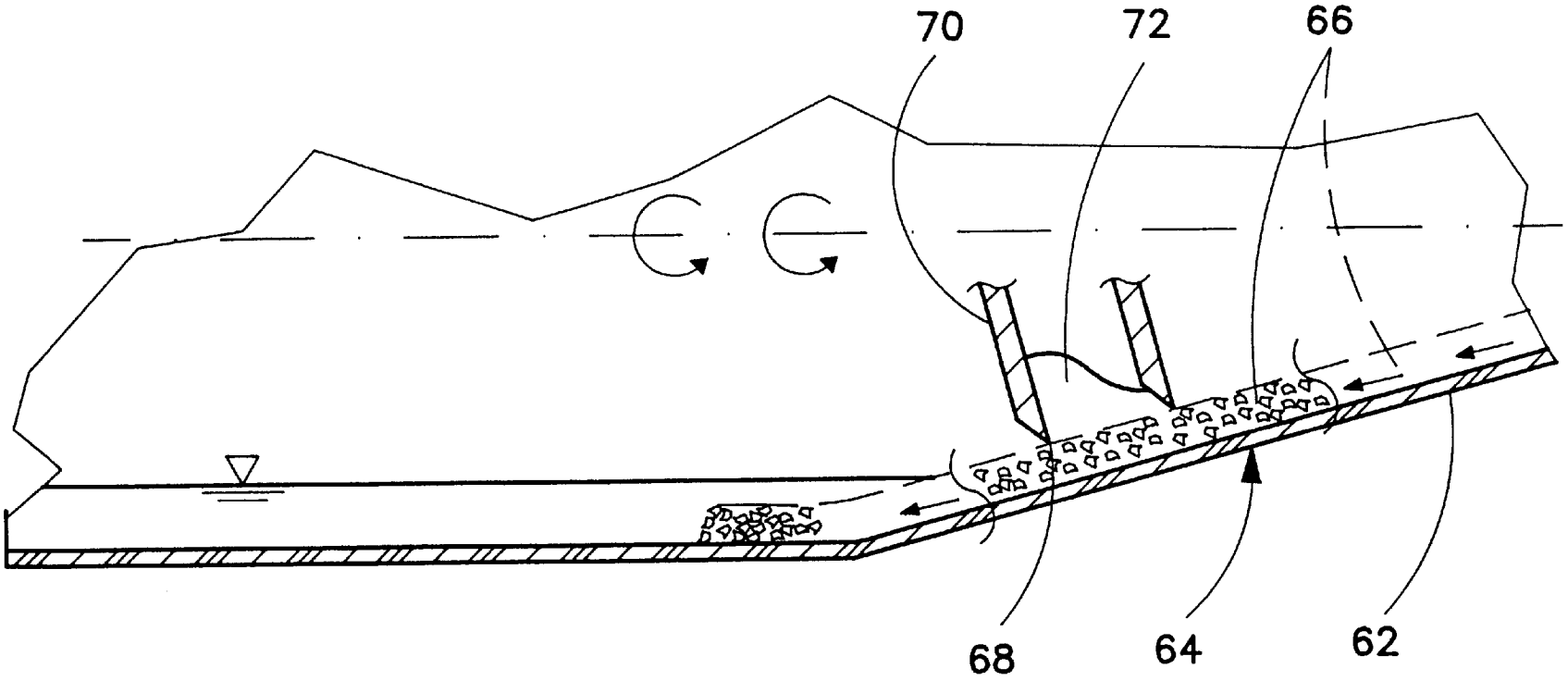
FIG. 5 is a schematic longitudinal cross-sectional view, on a larger scale, of a centrifuge with a particular embodiment of a beach liner in accordance with the present invention.

As shown in FIG. 5, a conical or beach section 62 of a centrifuge bowl 64 is lined with a replaceable porous liner 66 which has a close clearance from tips 68 of a screw-type conveyor blade 70. Liquid which is expressed off a cake layer 72 has a continuous drainage. The distance between a point where the liquid is expressed out of the cake 72 to the drainage path is particularly shortened in this design.

Figure 6:
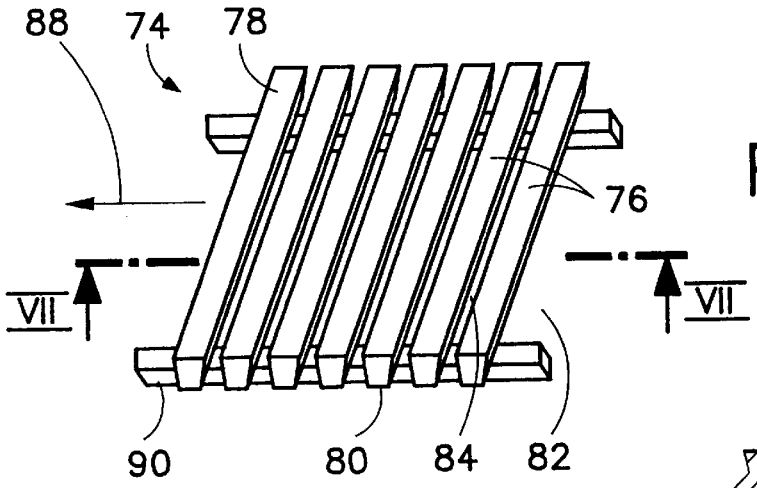
FIG. 6 is a schematic isometric view of a further beach liner in accordance with the present invention.
Figure 7:
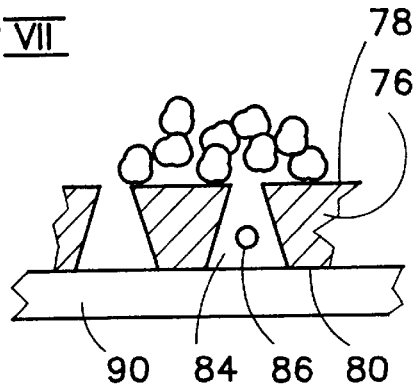
FIG. 7 is a schematic cross-sectional view taken along line VII—VII in FIG. 6, showing in greater detail the beach liner of FIG. 6.

FIGS. 6 and 7 show a liner 74 particularly comprising a plurality of trapezoidally profiled or wedge-shaped wires 76 oriented approximately in the circumferential direction. Each wire 76 has a wider inwardly facing surface 78 (FIG. 7) and a narrower surface 80 facing a filtrate flow channel 82. Adjacent wires 76 define a flared slot 84 tapering down in a radially inward direction to maximize the cake support area. Along the inner side, the width of slot 84 works to permit only liquid to pass and to retain the solids. Any minute particles 86 which find their ways through the narrowed inner end of a flared slot 84 pass unimpeded through remainder of the slot and along the liquid flow channel 82. Thus, wires 76 form a mesh or gating layer through which the smallest particles may pass without becoming wedged in the fluid flow channels causing clogging. Filtrate expressed from a cake layer on surfaces 78 first passes outwardly through fluid flow slots 84 and then axially along channel 82, as indicated by an arrow 88. Wire supports 90 are provided between wires 76 and the inner surface of the conical or beach section of the centrifuge bowl, thereby defining a plurality of channels 82.

Figure 8:
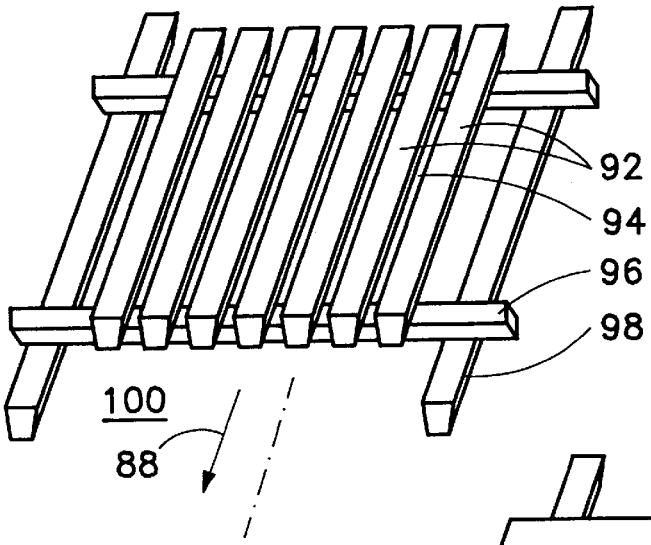
FIG. 8 is a schematic isometric view of another embodiment of a beach liner in accordance with the present invention.

FIG. 8 illustrated a modified liner comprising a plurality of trapezoidally profiled or wedge-shaped wires 92 oriented in the axial direction. Again, wires 92 define a plurality of outwardly flared or inwardly tapered slots 94. Slots 94 are the beginnings of a multiplicity of fluid flow paths along which expressed liquid is guided back to slurry pool in the cylindrical section of the bowl centrifuge. The liner of FIG. 8 works essentially in the same way and has essentially the same structure as the liner of FIGS. 6 and 7, except that two layers of supports are required, namely, circumferentially extending supports 96 and approximately axially extending supports 98. Supports 98 define a plurality of axially oriented filtrate guide channels 100 extending along the beach area to the slurry pool of the respective centrifuge. If only one layer of wire supports 96 were provided, the supports 96 would block the flow of liquid 88 back to the slurry pool.

In the embodiments of FIGS. 6, 7 and 8, instead of wedge-shaped wires 76 or 92, slots of variable geometries for the guiding of filtrate may be formed with precision from a solid thin plate, using a laser cutting tool on both inwardly and outwards facing surfaces of the plate.

Figure 9:
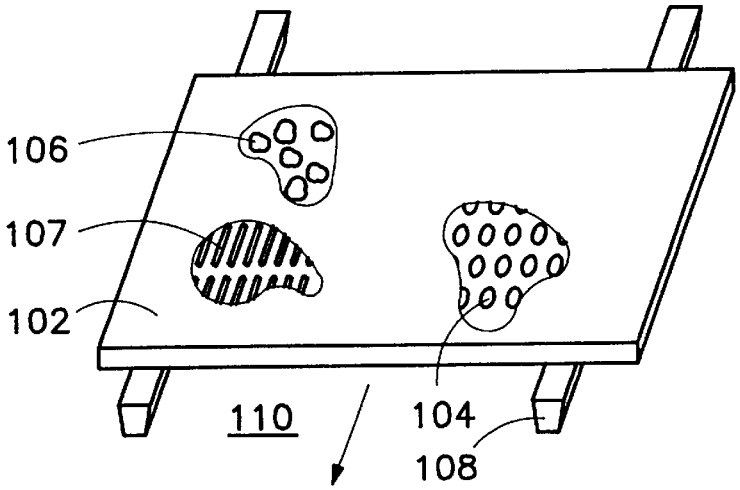
FIG. 9 is a schematic isometric view of yet another embodiment of a beach liner in accordance with the present invention.

As shown in FIG. 9, a standard thin perforated plate 102 is provided with either oblong holes 104, circular holes 106 or even slots 107. Plate 102 is supported on an inner surface of a beach area by axially oriented wires 108 which define multiple dedicated channels 110 for guiding expressed liquid axially back to a slurry pool.

Figure 10:
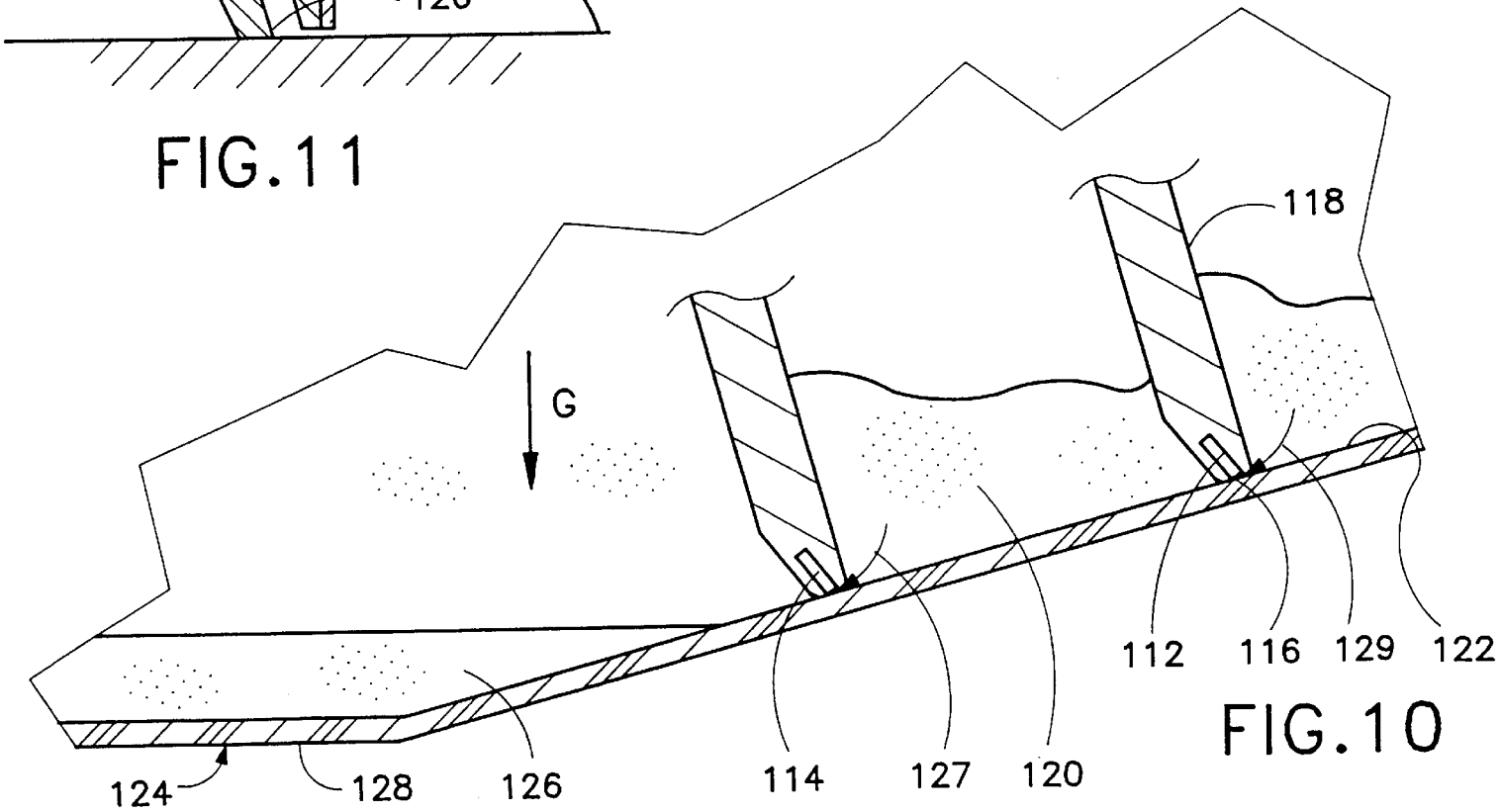
FIG. 10 is a schematic cross-sectional view of another liquid drainage technique in accordance with the present invention.

FIG. 10 depicts a liquid drainage path 112 formed by a recess 114 in a free end 116 of a conveyor blade 118. Drainage path 112 is helical, inasmuch as it follows the tip or end 116 of conveyor blade 118. Drainage path 112 guides fluid from cake 120 on a beach section 122 of a centrifuge bowl 124 to a slurry pool 126 in a cylindrical section 128 of bowl 124.

As indicated by arrows 127 and 129 in FIG. 10, liquid drains into helical drainage path or channel 112 from the upper side (as defined by the centrifugal gravity vector G) of the conveyor blade tip 116. Most of the liquid reaching path or channel 112 flows therethrough down to the slurry pool 126, as path or channel 112 is the path of least resistance.

Figure 11:
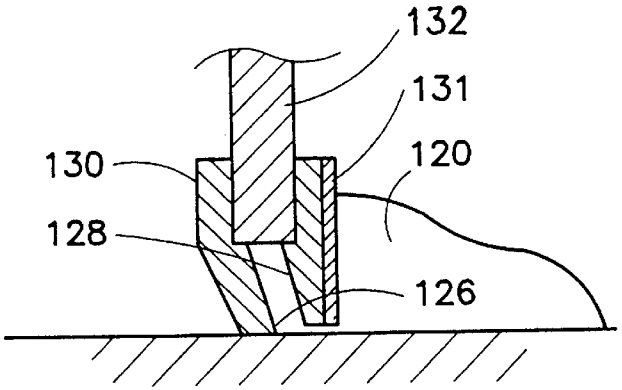
FIG. 11 is a schematic cross-sectional view of a conveyor blade tip, similar to a portion of FIG. 10, showing a helical liquid flow channel formed at the blade tip.

As illustrated in FIG. 11, a liquid drainage path 126 is more particularly formed by a recess 128 built into a blade tip 130. Tip 130 has a generally "A" shaped profile and is provided on a leading side with a protective surface 131 made of a wear resistant material such as tungsten carbide. One end of the A is braced to a blade end 132, and the other end of the A forms a continuous passage for expressed liquid to be returned to the liquid pool. Cake 120 extends only partially "up" the tungsten carbide surface 131 at all times during operation of the centrifuge.

Figure 11A:
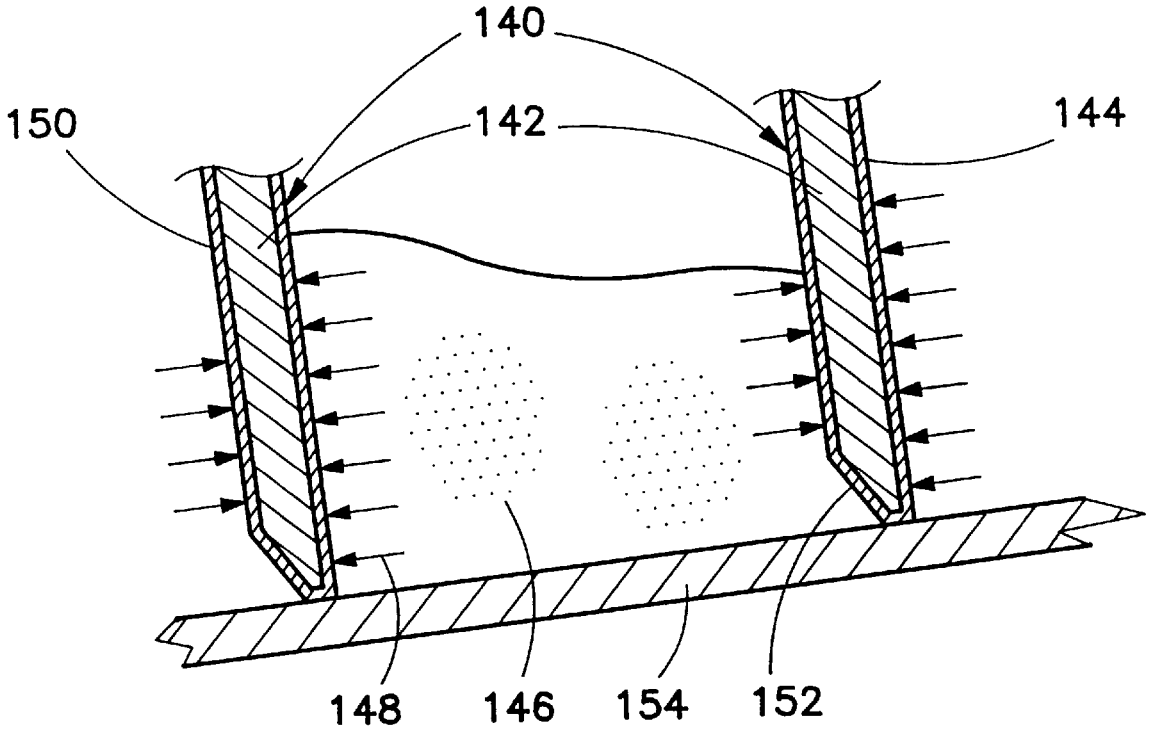
FIG. 11A is a schematic cross-sectional view of a conveyor blade, similar to a portion of FIG. 10, showing a helical liquid flow channel formed in the conveyor blade.

FIG. 11A depicts a blade member 140 of a cake conveyor (not separately referenced). The blade member 140 is formed with a helical cavity 142 which defines a flow path for returning expressed liquid to a slurry pool (not shown). Conveyor blade member 140 is provided at least on a downstream side with a perforated panel or filter surface 144 through which liquid expressed from a cake layer 146 passes into cavity 142, as indicated by arrows 148. Conveyor blade member 140 is optionally provided on an upstream side with a perforated panel or filter surface 150. Along an outside edge or tip 152, adjacent to a bowl wall 154, conveyor blade member 140 is sealed to liquid flow.

Figure 1A:
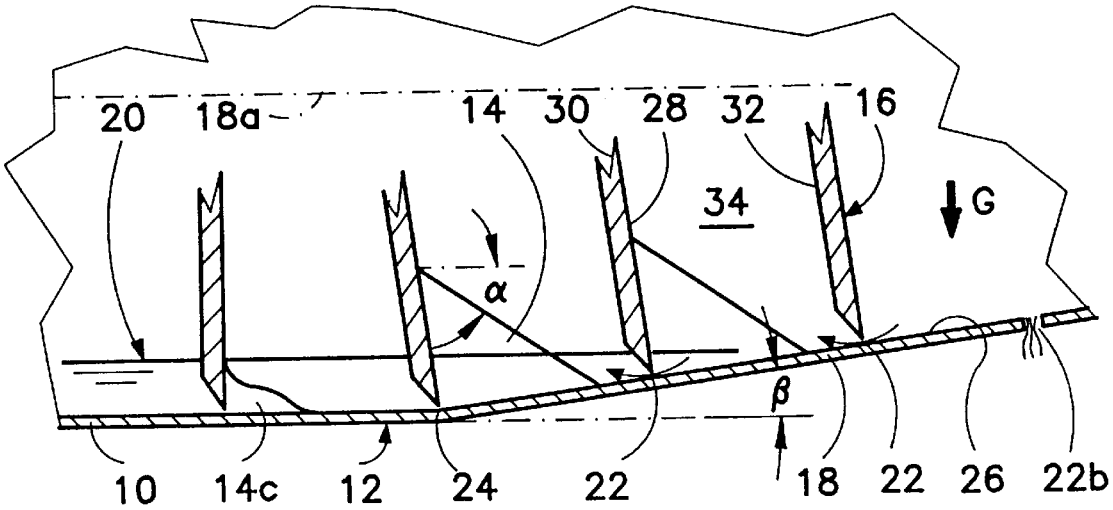
PRIOR ART FIG. 1A
FIG. 1A is a diagrammatically represented partial cross-sectional view of an existing centrifuge, showing cake in a beach area at a relatively low cake throughput rate. The cake profile is greatly exaggerated for purposes of illustration.
Figure 1B:
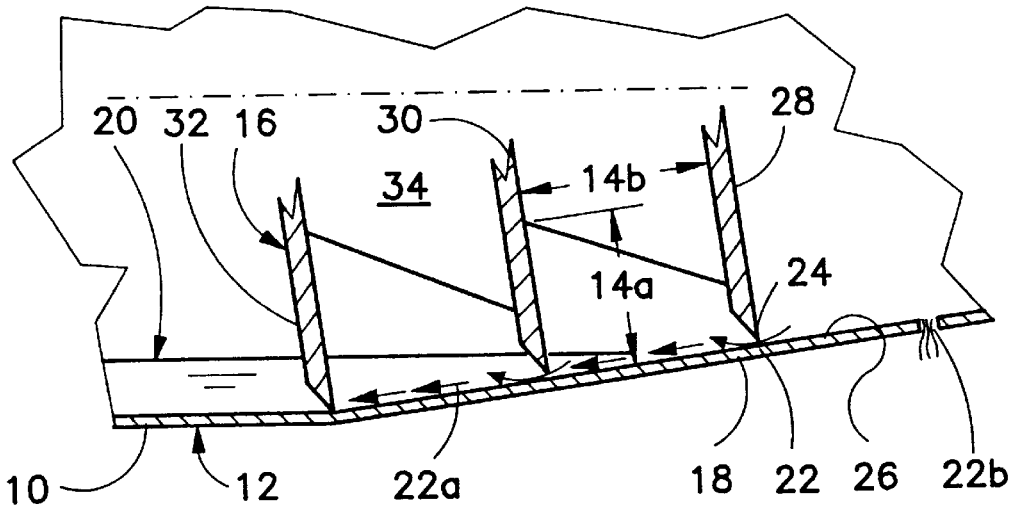
PRIOR ART FIG. 1B
FIG. 1B is a view similar to FIG. 1A, showing cake in the beach area at a higher cake throughput rate. Again, the cake profile is exaggerated for purposes of illustration.
Figure 2:
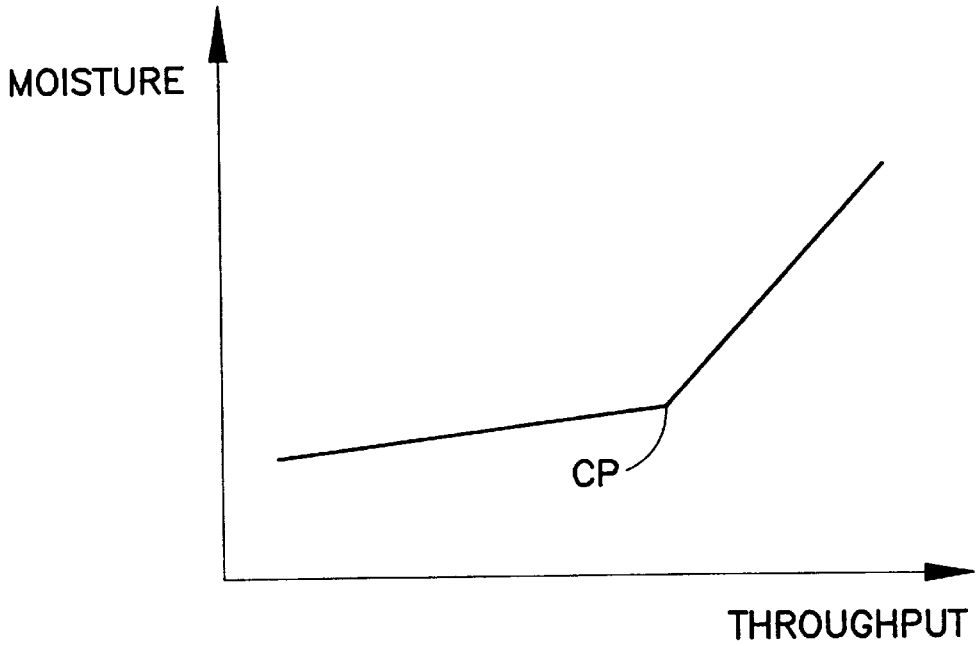
PRIOR ART FIG. 2
FIG. 2 is a graph illustrating the variation of cake moisture as a function of cake throughput in the conventional centrifuge design of FIGS. 1A and 1B.

All designs described herein make a provision for liquid drainage irrespective of whether the cake would take up the entire channel between successive conveyor blade wraps. In each design, the moisture - throughput capacity should be significantly improved. The moisture increases moderately with increasing cake discharge rate for the entire flow rate range with perhaps torque and chatter limitations. Presently, almost all solid bowls for dewatering polymer slurries are limited to operate near the critical point CP (FIGS. 2 and 12).

Figure 12:
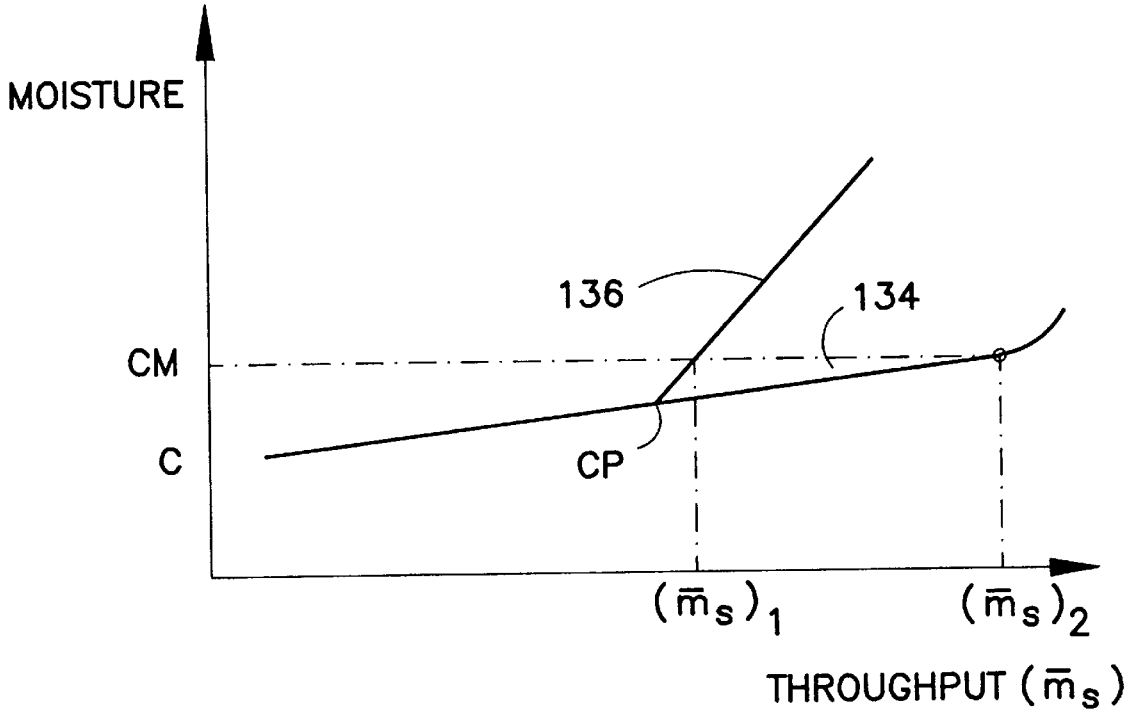
FIG. 12 is a graph illustrating the variation of cake moisture as a function of cake throughput in a centrifuge incorporating a liquid drainage channel or channels in accordance with the invention.

FIG. 12 depicts a moisture-vs-flow rate function 134 expected for centrifuges employing the present designs, in comparison with a moisture-vs-cake throughput function 136 for current designs. At flow rates below the critical point CP, the moisture-vs-cake throughput function is the same whether or not any of the present designs are used.

For a given cake moisture level CM above that at the critical point CP, it is clear from FIG. 12 that a centrifuge with a liner or dedicated liquid return paths as described herein will have a substantially enhanced throughput $(m_s)_2$ in comparison with the throughput $(m_s)_1$ of conventional centrifuge designs.

Figure 13:
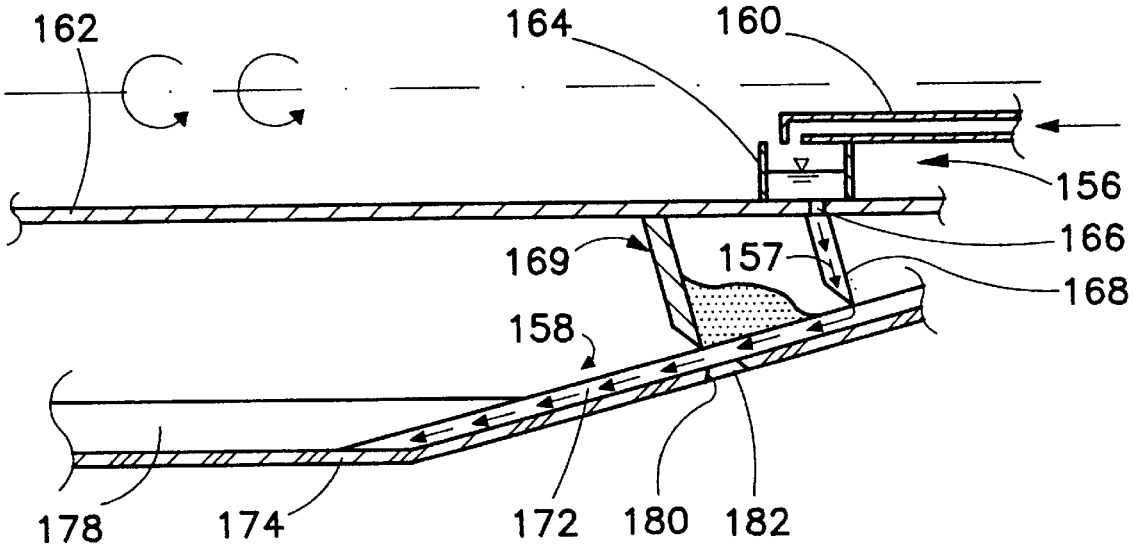
FIG. 13 is a schematic longitudinal cross-sectional view of a centrifuge with a beach liner and wash liquid delivery in accordance with the present invention.

FIG. 13 shows a solid bowl centrifuge with a feed path or guide 156 for delivering a wash liquid, represented by arrows 157 to a dedicated liquid drainage path 158 as described above. For liquid drainage path 158 to operate effectively, it is important that the path is kept clear of solids deposits especially fine cake solids which have been carried into the drainage path together with the mother liquid. The delivery of a wash or cleaning liquid to drainage path 158 serves to clear or unclog the path if solids start to buildup along the drainage path.

Figure 13A:
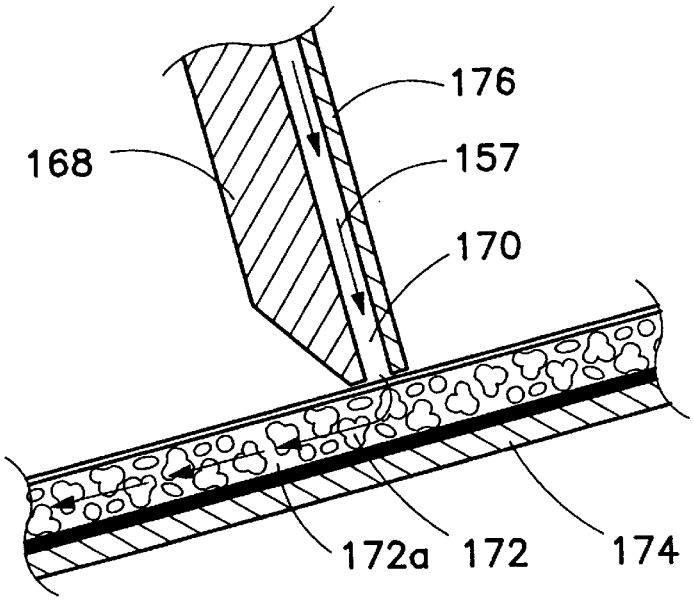
FIG. 13A is a schematic cross-sectional view of a blade tip of the conveyor of FIG. 13, showing a wash liquid passage provided in the conveyor blade.

Wash-liquid feed path 156 includes a conduit 160 extending axially inside a conveyor hub 162. Conduit 160 guides wash liquid to a reservoir 164. Reservoir 164 communicates via an opening 166 in hub 162 with a hollow wrap 168 of a conveyor blade 169. As illustrated in FIG. 13A, wrap 168 is provided with a passageway 170 extending the width of the wrap to deliver cleaning liquid to drainage path 158.

In FIGS. 13 and 13A, drainage path 158 is defined exemplarily by a porous liner 172 mounted to and forming a part of a bowl wall 174. The outer end of conveyor wrap 168 is provided with a seal 176 for ensuring the delivery of wash liquid from passageway 170 to porous liner 172. The wash liquid serves to purge liner 172 of solids particles 172*a* by washing the particles down to a slurry pool 178.

Conveyor wrap 168 is located near the cake exit (not shown) of the centrifuge so that wash liquid introduced into porous liner 172 via wrap 168 drains downhill, sweeping solids towards pool 178 and thus keeping path 156 clear of solids particles 172*a*. An access hole 180 closed by a removable plug 182 may be provided in bowl wall 174 for facilitating periodic flushing operations.

Figure 14:
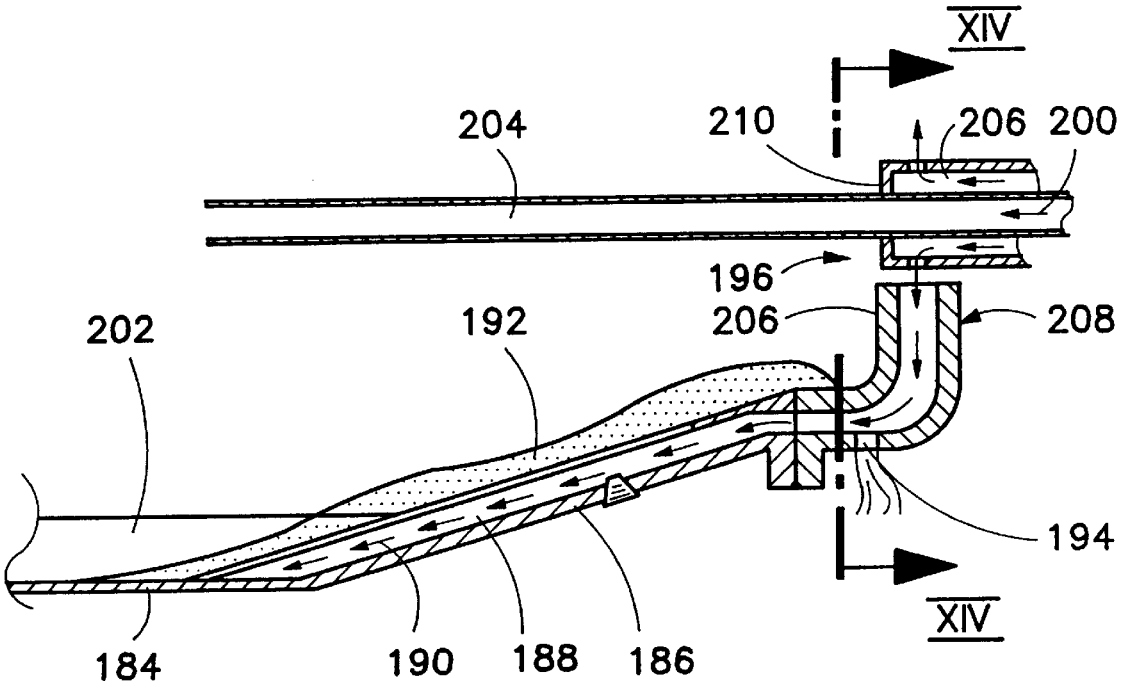
FIG. 14 is a schematic partial longitudinal cross-sectional view of a centrifuge with a beach liner and wash liquid delivery provided through a rotating bowl head, in accordance with the present invention.

FIG. 14 shows a centrifuge having a solid bowl 184 with an inclined beach section 186 and a porous liner 188 attached to the beach section along an inner side thereof. Liner 188 provides a generally axial return or drainage path 190 for liquid expressed from a cake layer 192 moving up the beach section towards a cake discharge 194 under the action of a nonillustrated conveyor. A feed path or guide 196 is provided for delivering a wash liquid, represented by arrows 200, to drainage path 190. Wash liquid 200 maintains drainage path 190 clear of solids deposits especially fine cake solids which have been carried into the drainage path together with the mother liquid. Wash liquid 200 entrains cake particles and carries them to a slurry pool 202.

Figure 14A:
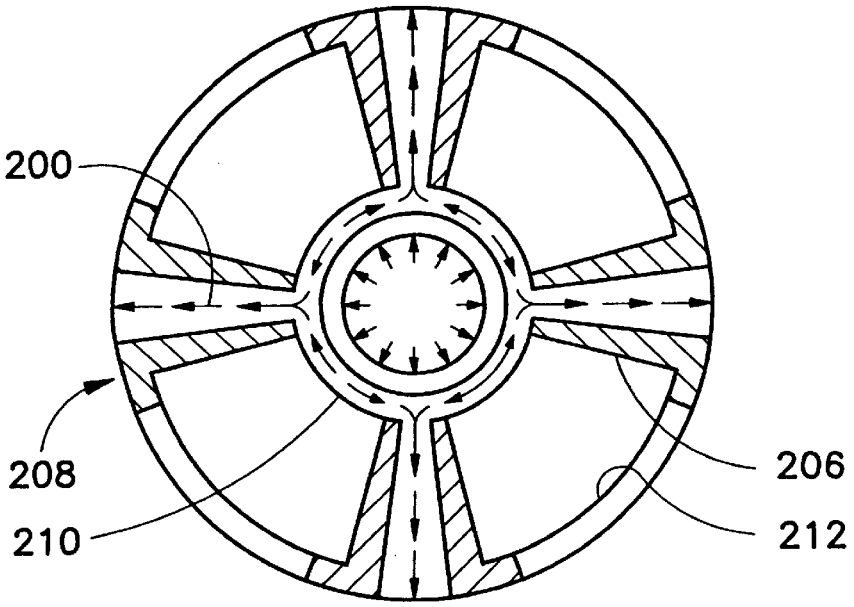
FIG. 14A is a schematic transverse cross-sectional view taken along line XIV—XIV in FIG. 14.

Wash liquid path or guide 196 includes a feed pipe 204 disposed in a conveyor hub (not shown) and mounted in a pipe annulus 206. The wash liquid is delivered to porous liner 188 via hollow spokes 206 of a bowl head 208 (see FIG. 14A). Spokes 206 communicate at an upstream side with an annular reservoir or chamber 210 in annulus 206. The introduction of wash liquid 200 at a small diameter prevents mixing or cross-contamination. Reference numeral 212 designates the cake discharge diameter.

A dedicated liquid flow or drainage path as described herein is best designed to avoid any bends or traps where solids can deposit, thus jamming the path.

Figure 15A:
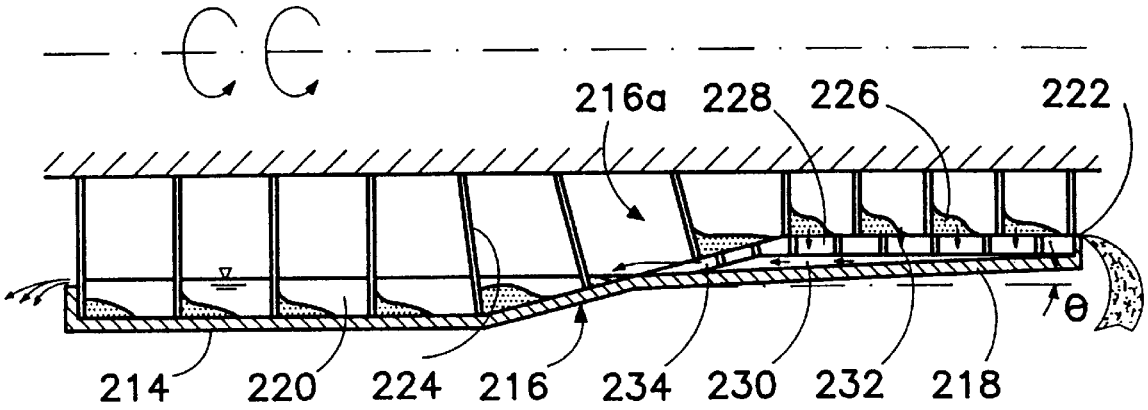
FIG. 15A is a schematic longitudinal cross-sectional view of a centrifuge with a beach liner and filter screen in accordance with the present invention.

FIG. 15A depicts a centrifuge having a cylindrical solid bowl 214 with a beach section 216 and a slightly conical wall 218 located downstream of the beach section along a cake flow path extending from a pool 220 to a cake discharge 222. A conveyor 224 moves cake 226 along beach section 216 and a beach extension 216*a*. Beach extension 216*a* includes two parts, namely, wall 218 and a substantially cylindrical screen 228 located inwardly of wall 218 coaxially therewith. Screen 228 is spaced from wall 218 to define a dedicated liquid flow path or space 230 for returning, to pool 220, liquid expressed from cake 226 (arrows 232) during its transit along screen 228 under the action of conveyor 224. To that end, bowl wall 218 is inclined at an angle θ from the axis of the machine so that a component of centrifugal gravity drives the collected filtrate liquid towards pool 220. Beach section 216 includes a downstream portion 234 which is formed of screen material for permitting the return of expressed fluid from path or space 230 to pool 232. Screen 228 is attached to bowl 214 and particularly to beach section 216 and wall 218 and can be considered to form part of the bowl. Pool 220 is set so that it is approximately level with the upper or inner edge of the solid portion of beach section 216, where that solid portion joins screen portion 234. The level of pool 220 is set to avoid spillage of the pool onto screen portion 234. Because the cylindrical screen section is perpendicular to the G field, less frictional resistance and hence less conveyance torque os required to scroll the cake across the screen section.

Path of space 230 is designed with minimal liquid holdup volume to allow the filtrate liquid the sweep the space at high velocity, thus providing self-cleaning of path or space 230 to prevent sedimentation which would clog up the filtrate drainage path. If necessary, wash liquid may be introduced, as discussed above with reference to FIGS. 13–14A.

Figure 15B:
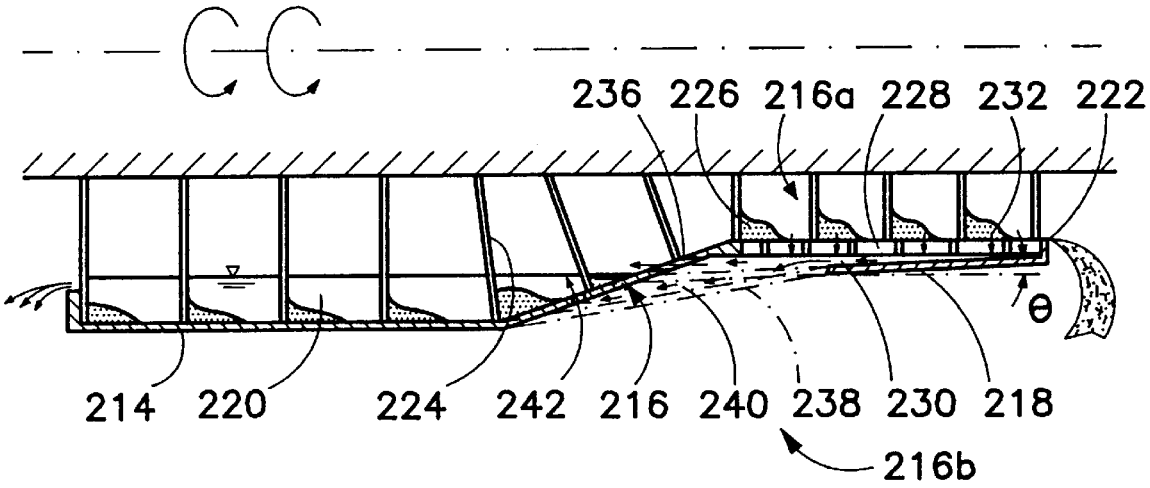
FIG. 15B is a schematic longitudinal cross-sectional view of another centrifuge with a modified beach liner and filter screen in accordance with the present invention.

FIG. 15B illustrates a modification of the centrifuge of FIG. 15A wherein screen portion 234 of beach section 216 is omitted. Instead, beach section 216 extends all the way to screen 228 and is connected thereto. Beach section 216 is formed at an upper or downstream side with a plurality of openings 236, located above the level of pool 220, for enabling the passage of liquid from flow path or space 230 to the pool.

In an alternative embodiment depicted in phantom lines in FIG. 15B, a composite beach 216*b* includes beach section 216 and a frustoconical bowl wall extension 238 substantially coextensive with beach section 216 and provided outside of the beach section to define therewith a liquid return or drainage path 240 extending from path or space 230 to one or more openings 242 provided in beach section 216 at a lower end thereof beneath the level of pool 220. Openings 242 are provided in addition to or alternatively instead of openings 236. Where openings 236 are omitted, the phantom-line embodiment of FIG. 15B serves to avoid direct entrainment of the returning filtrate by the cake being conveying up the beach section. Liquid return or drainage path 240 extends through an annulus space designed so that the filtrate passes at a high velocity to avoid sedimentation of particles. As discussed above, a removably plugged access may be provided for periodically cleaning the annulus space.

In the alternative embodiment of FIG. 15B, composite beach 216*b* is composed of beach section 216, bowl wall extension 238, screen 228, and wall 218. A composite dedicated liquid return or drainage path (not designated) includes path or space 230 and path 240.

The centrifuges of FIGS. 15A and 15B may be used as alternatives to screen bowl centrifuges having external recycling. In those prior art centrifuges, used to dewater slurry having granular solids, sediment which is dewatered during passage up a beach section is further dewatered along a cylindrical screen section of the bowl. Liquid drained off the rotating screen of the centrifuge is collected in a stationary hopper. Where the filtrate contains a substantial amount of solids, it may be recycled and combined with fresh feed to the centrifuge. This recycled stream can be as much as 10% of the fresh feed. For some applications, recycling of filtrate is not feasible as additional equipment such as lines and a pump requires additional operating and capital expenditures. The embodiments of FIGS. 15A and 15B, which provide a dedicated return or drainage flow path for the screen filtrate inside the centrifuge, represent a solution to those applications.

The centrifuges of FIGS. 15A and 15B are a hybrid between a screen bowl and a solid bowl centrifuge. For purposes of the instant disclosure, the centrifuges of FIGS. 15A and 15B are treated as solid bowls because of the solid outer walls, even though the centrifuges are used to process screen-bowl-type sediments.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are offered by way of example to facilitate comprehension of the invention and should not be construed to limit the scope thereof.

What is claimed is:

1. A centrifuge comprising:

a centrifuge bowl having a beach section located between a pool area at one end of said bowl and a cake discharge opening at an opposite end of said bowl;

a conveyor for conveying cake from said pool area to said cake discharge opening along a cake path on an inner surface of said bowl, said conveyor having a conveyor blade spaced from said inner surface by a gap, said bowl constituting a first centrifuge member and said conveyor constituting a second centrifuge member; and structure, connected to one of the centrifuge members, defining a dedicated flow path for draining away liquid expressed from cake on said beach section while maintaining cake flow up said beach section to said cake discharge opening, said dedicated flow path being different from said gap and separated from the cake path on said beach section, said structure having a filtration surface facing cake on said beach section, said structure defining multiple profiled fluid paths each extending away from said filtration surface and each having a width increasing generally with distance from said filtration surface, thereby preventing clogging of said fluid flow paths and said filtration surface.

2. The centrifuge defined in claim 1 wherein said structure includes a liner provided along an inner surface of said beach section, said filtration surface being an inwardly facing surface of said liner.

3. The centrifuge defined in claim 2 wherein said liner defines said dedicated flow path as including a plurality of channels extending from said beach section to said pool area.

4. The centrifuge defined in claim 3 wherein said flow channels extend generally axially.

5. The centrifuge defined in claim 2 wherein said liner includes a plurality of approximately parallel wires disposed on said beach section via a plurality of spacers.

6. The centrifuge defined in claim 5 wherein said wires and said spacers are connected to one another to form a cage or basket insert.

7. The centrifuge defined in claim 5 wherein said wires have wedge-shaped profiles, said profiles have inwardly facing surfaces and outwardly facing surfaces, said outwardly facing surfaces being smaller than said inwardly facing surfaces, thereby defining said filtration surface at a radially inward side of said profiles and further defining said fluid flow paths as radially extending flared slots which widen from an upstream side to a downstream side.

8. The centrifuge defined in claim 2 wherein said liner includes a perforated conical plate and spacer elements disposed between said plate and said beach section to provide said dedicated flow path.

9. The centrifuge defined in claim 8 wherein said plate is provided with perforations taken from the group consisting essentially of slots and holes.

10. The centrifuge defined in claim 2 wherein said liner is made of a porous material.

11. The centrifuge defined in claim 1 wherein said structure includes a helical channel or recess formed in said conveyor blade for guiding liquid from said beach section to said pool area.

12. The centrifuge defined in claim 11 wherein said channel or recess is formed in a blade tip having a generally A-shaped profile.

13. The centrifuge defined in claim 12 wherein said blade tip is provided on a leading side with a protective surface made of a wear resistant material.

14. The centrifuge defined in claim 11 wherein said conveyor blade is provided with said filtration surface for liquid filtration.

15. The centrifuge defined in claim 1 wherein said filtration surface presents a filter structure inhibiting cake particles from entering said fluid flow paths and said dedicated flow path while permitting flow of expressed liquid from the cake through said fluid flow paths to said dedicated flow path.

16. The centrifuge defined in claim 1, further comprising a feed path for feeding cleaning liquid to said dedicated flow path for clearing said dedicated flow path of clogging cake particles.

17. The centrifuge defined in claim 16 wherein said feed path extends through said conveyor blade.

18. The centrifuge defined in claim 16, further comprising a bowl head at a cake discharge end of said bowl, said feed path extending through a channel in said bowl head.

19. A method for operating a centrifuge comprising a centrifuge bowl having a beach section located between a pool area at one and of said bowl and a cake discharge opening at an opposite end of said bowl, comprising:

rotating said bowl about a rotation axis;

during rotation of said bowl, moving cake from said pool area to said cake discharge opening along a cake path on said beach section;

also during rotation of said bowl, capturing liquid expressed from said cake along said beach section;

guiding the captured liquid away from the cake on said beach section via profiled fluid flow paths of generally increasing width extending from a filtration surface at said beach section to a dedicated flow path separated from said cake path, the increasing width of said profiled fluid flow paths serving to prevent clogging of said filtration surface and said profiled flow paths; and during capturing and guiding of said liquid, substantially maintaining a flow of cake along said beach section to said cake discharge opening.

20. The method defined in claim 19 wherein the guiding of the captured liquid includes channeling the captured liquid into a liner provided along an inner surface of said beach section, said filtration surface being provided on said liner.

21. The method defined in claim 20 wherein the guiding of the captured liquid includes directing the captured liquid along generally axially extending flow channels.

22. The method defined in claim 20, further comprising directing the captured liquid through connecting pores in said liner.

23. The method defined in claim 19, further comprising directing the captured liquid along a helical channel or recess formed in a conveyor blade in the centrifuge.

24. The method defined in claim 19, further comprising directing the captured liquid from said beach section back to said pool area.

25. The method defined in claim 24, further comprising directing the captured liquid along generally axially extending flow channels.

26. The method defined in claim 19 wherein the capturing of the expressed liquid includes filtering the liquid to inhibit cake particles from entering said fluid flow paths.

27. The method defined in claim 19, further feeding cleaning liquid to said dedicated flow path for clearing said dedicated flow path of clogging cake particles.

28. The method defined in claim 27 wherein the feeding of said cleaning liquid includes guiding said cleaning liquid through a conveyor blade.

29. The method defined in claim 27 wherein the feeding of said cleaning liquid includes guiding said cleaning liquid through a bowl head at a cake discharge end of said bowl.

30. A centrifuge comprising:

a centrifuge bowl having a beach section defining a cake flow path extending from a pool area at one end of said bowl and a cake discharge opening at an opposite end of said bowl;

a conveyor for conveying cake from said pool area to said cake discharge opening along said cake path, said conveyor having a conveyor blade spaced from an inner surface of said bowl by a gap, said bowl constituting a first centrifuge member and said conveyor constituting a second centrifuge member; and structure, connected to one of the centrifuge members, defining a dedicated flow path for draining away liquid expressed from cake in said beach section while enabling maintenance of cake flow along said cake flow path extending up said beach section to said cake discharge opening, said dedicated flow path extending from said beach section to said pool area, said dedicated flow path being different from said gap and separated from said cake flow path, said structure including surfaces completely separating and spacing said dedicated flow path from said cake flow path, said structure having a filtration surface facing cake on said beach section, said structure defining multiple profiled fluid flow paths each extending away from said filtration surface and each having a width increasing generally with distance from said filtration surface, thereby preventing clogging of said fluid flow paths and said filtration surface.

* * * * *